US006523478B1

(12) United States Patent
Gonzalez et al.

(10) Patent No.: US 6,523,478 B1
(45) Date of Patent: Feb. 25, 2003

(54) RIFLE-LAUNCHED NON-LETHAL CARGO DISPENSER

(75) Inventors: Noel Gonzalez, Oviedo, FL (US); Daniel J. Hartman, Orlando, FL (US); William G. Rouse, Haure De Grace, MD (US); Raymond J. Malecki, Perry Hall, MD (US); Paul W. Morgan, Altamonte Springs, FL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/954,282

(22) Filed: Sep. 10, 2001

(51) Int. Cl.[7] ..... F41C 9/08

(52) U.S. Cl. ..... 102/485; 102/216; 89/1.3; 42/105

(58) Field of Search ..... 102/483, 484, 102/485, 216; 89/1.3; 42/51, 105

(56) References Cited

U.S. PATENT DOCUMENTS 3,156,187 A * 11/1964 Batou
3,620,162 A * 11/1971 King
3,726,036 A * 4/1973 Jennings et al. ..... 244/3.29
4,013,011 A * 3/1977 Gabriels
4,656,947 A * 4/1987 Gordon et al. ..... 102/483
4,793,259 A * 12/1988 Ambrosi et al. ..... 102/485
5,574,245 A 11/1996 Buc ..... 102/485
5,677,509 A * 10/1997 Potvin et al. ..... 102/498
6,047,644 A 4/2000 Malecki et al. ..... 102/367

FOREIGN PATENT DOCUMENTS

GB 479982 * 2/1938 ..... 102/483
GB 481254 * 3/1938 ..... 102/483

* cited by examiner

*Primary Examiner*—Stephen M. Johnson
(74) *Attorney, Agent, or Firm*—Ulysses John Biffoni

(57) ABSTRACT

A rifle muzzle launched projectile having a launch tube defining an interior cavity, and having an opening at one end with an inner diameter sized to fit over the end of a rifle muzzle; a bullet trap located in the launch tube cavity; and a payload assembly mounted on the launch tube. The payload assembly is further configured for safely releasing a payload in a controlled manner. The payload assembly also includes a casing for retaining an aerosol composition; a propellant located in the casing; a primer for igniting the propellant; and a frangible portion of the casing in contact with the aerosol composition.

12 Claims, 8 Drawing Sheets

RIFLE-LAUNCHED NON-LETHAL CARGO DISPENSER

GOVERNMENTAL INTEREST

The invention described herein may be manufactured, licensed, and used by or for the U.S. Government.

FIELD OF THE INVENTION

The present invention relates generally to a projectile, more particularly to a projectile adapted for launching from the end of a rifle muzzle for safely and effectively delivering a payload comprising, for example, one or more discrete electrical or mechanical devices, or a substance capable of being discharged in the form of an aerosol.

BACKGROUND OF THE INVENTION

Aerosols are relatively stable suspensions of liquid or solid particles in gas, especially air. Smoke, fog, and mist are typical examples of aerosols. Aerosols have been used extensively by the military for offensive and defensive purposes in order to incapacitate or confuse enemy troops and/or to protect friendly combat forces. In civilian use, aerosol dispersal is sometimes used mainly for police and firefighting purposes. Such aerosol payloads have included smoke, obscurant, fire retarding agents, crowd control agents, dye indicators, chemical/biological agents, and the like.

In the course of a military operation, a military force may be targeted by visual, ultraviolet, infrared, millimeter wave radar sensors, and the like. To counter such targeting attempts, various types of filler payloads which are capable of being disseminated in the form of an aerosol, are prepared for obscuring and protecting potential targets. By way of example, the filler payload may include carbon fibers to block energy in the radar signal region of the electromagnetic spectrum, smoke particles to obscure visual detection, and brass flakes to interfere with infrared detection arid targeting. In civilian use, aerosols are dispersed by police and fire units for controlling a large unruly crowd, subduing a perpetrator, carrying out a diversionary tactic, providing personal protection, and/or marking or signaling. Aerosols used in fire fighting situations provide fire fighters the ability to remove fire sustaining elements from an environment, such as heat and oxygen. Aerosols currently used are typically supplied by remote hoses and/or vehicles and generally require an initiation time delay and are dispersed within a spray.

The aerosol generating devices typically used by the military incorporate high explosive devices or grenades to disperse the corresponding particle or aerosol payloads. This presents a problem since such high explosive devices and grenades tends to yield shrapnel and shock waves which can potentially cause injury and damage. Typically, in order to disperse the aerosol payloads at a particular site, the devices are either thrown by hand or delivered by specialized launchers. Throwing the aerosol generating device is often inefficient and inaccurate and limited in providing suitable delivery ranges. The use of specialized launchers are costlier, more complicated and less versatile. Each of these modes of delivery involve significant risks to the operator dispatching the device.

Rifle muzzle launched projectiles have been in existence for years and are adapted to be accurately launched over considerable distance from the end of a rifle muzzle. This method of launching projectiles provides advantages in terms of range and accuracy over hand-thrown counterparts and requires only a conventional rifle instead of a specialized launcher. Grenades and explosive devices have been adapted to be launched in this manner. Such muzzle-launched projectiles commonly employ a bullet trap-rifle cartridge combination where the end portion of the projectile in the form of a launch tube is slipped over the end of a rifle muzzle. The projectile is aimed at a suitable target prior to firing of the rifle. When the rifle is fired, the gases generated from the rifle cartridge pressurizes the internal cavity of the projectile launch tube and propels the projectile off of the riffle muzzle. This entrapped gas pressure provides the projectile with a primary means of propulsion. The bullet fired is safely captured in the bullet trap.

In view of the foregoing, there is a need to deliver and disperse a payload comprising an aerosol forming substance without the use of high-explosives, the formation of shrapnel and shock wave. In addition, the devices for rapid dispersion and delivery must be capable of being readily launched from existing conventional rifle muzzles, while providing efficient and effective target accuracy and range. Furthermore, the projectile is adapted for delivering a range of payloads while inflicting minimal injury and damage near or around target areas.

In the same manner, there is also a need for delivering non-aerosol payloads or articles, including, but not limited to, flash grenades, concussion grenades, nets, noise generators, stun balls, tire puncturing elements, electromagnetic pulse generators, mines or bomblets, listening devices, signal emitting objects, unmanned aerial vehicles, biological/chemical agents, and the like for efficient, rapid dispersal and delivery.

SUMMARY OF THE INVENTION

The present invention is directed to a rifle muzzle launched projectile which is constructed for rapid and efficient delivery of a payload to a target site. The projectile is further adapted to release the payload in a safe controlled manner without producing dangerous shrapnel and fragmentation or explosive shockwaves. The projectiles may be launched over a considerable range with remarkable accuracy and precision from any conventional rifle. The payload may include aerosol-based substances, one or more electronic and/or mechanical devices, and the like.

In one aspect of the present invention there is provided a rifle muzzle launched projectile which comprises:

- a launch tube defining an interior cavity, and having an opening at one end with an inner diameter sized to fit over the end of a muzzle of a rifle;
- a bullet trap fixedly located in the launch tube cavity opposite from the launch tube opening, the bullet trap adapted for safely capturing a bullet fired from the muzzle; and
- a payload assembly mounted on the launch tube opposite from the opening end, the payload assembly further configured for safely releasing a payload associated therewith in a controlled manner during delivery in absence of shrapnel formation or fragmentation.

BRIEF DESCRIPTION OF THE DRAWINGS

Various embodiments of the invention are described in detail below with reference to the drawings, in which like items are identified by the same reference designation, wherein.

DETAILED DESCRIPTION OF THE INVENTION

The present invention is directed to a payload delivering projectile which is capable of being launched from the end of a rifle muzzle in a safe and effective manner. The use of a payload delivering projectile which can be launched from the muzzle end of a rifle, advantageously eliminates the need for acquiring specialized launching equipment and projectiles, and is preferable over less effective hand-thrown methods of delivery. The projectile of the present invention is further adapted for carrying a range of payloads and dispensing the payload at a distance away from the launch point in a safe and accurate manner. The mode of dispensing the payload is relatively safe to the persons or structures near the projectile's target. The projectile of the present invention advantageously comprises a non-metallic frangible casing which is adapted to rupture under controlled build-up of pressure without inflicting serious injury or damage. The projectile utilizes controlled pressurization of the frangible casing to effect a safe blowout and dispersal of the corresponding payload. In this manner, the formation of shrapnel or dangerous fragmentation and shock wave associated with explosive devices, is minimized or eliminated causing little or no injury to persons and/or damage to structures located at or near the target area.

The term "payload" means herein to include any substance, material or device which is desired to be expeditiously delivered to a target area using the projectile of the present invention as the carrying and dispersing device. The payload may include, but is not limited to, a substance capable of being dispersed in the form of an aerosol, electronic devices, unmanned aerial vehicles, flash-bang munitions, sting balls, ground sensors, mines, bomblets, concussion grenades, tire puncturing elements, signal emitting devices, and the like. The aerosol substance is preferably selected from the group consisting of smoke, crowd control agents, biological/chemical agents, obscurant, target marking compounds, dyes and inks, chaffs and the like.

Figure 1:
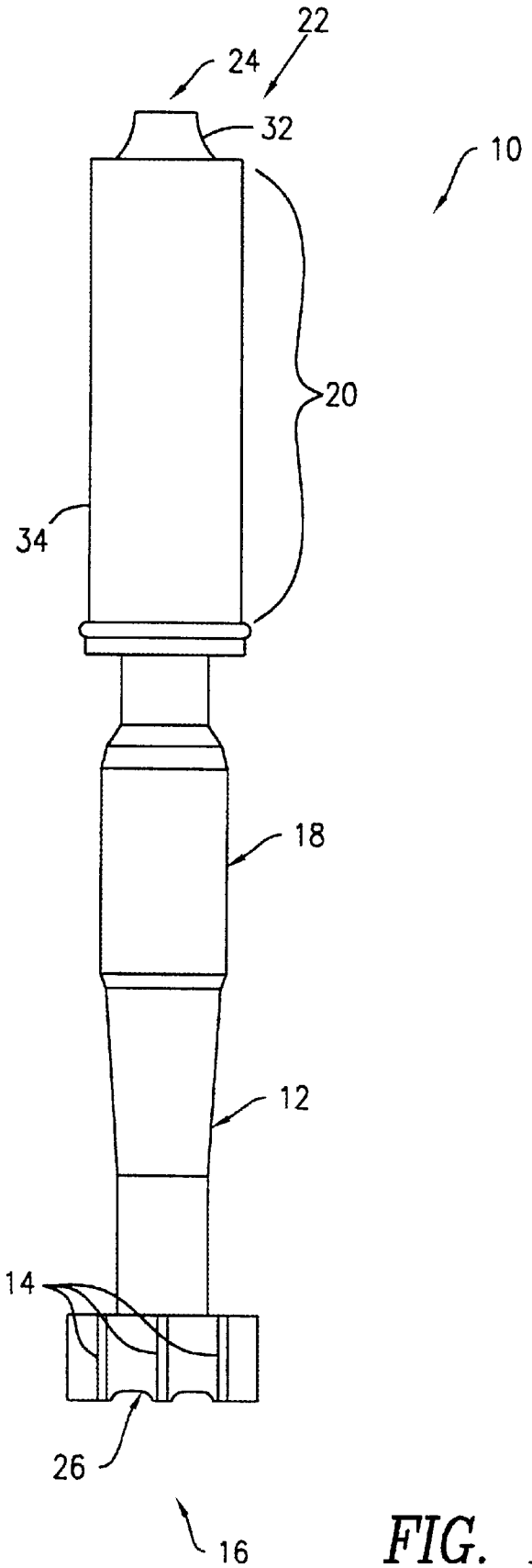
FIG. 1 is a side elevational view of a rifle muzzle-launched projectile for a first embodiment of the present invention.
Figure 3:
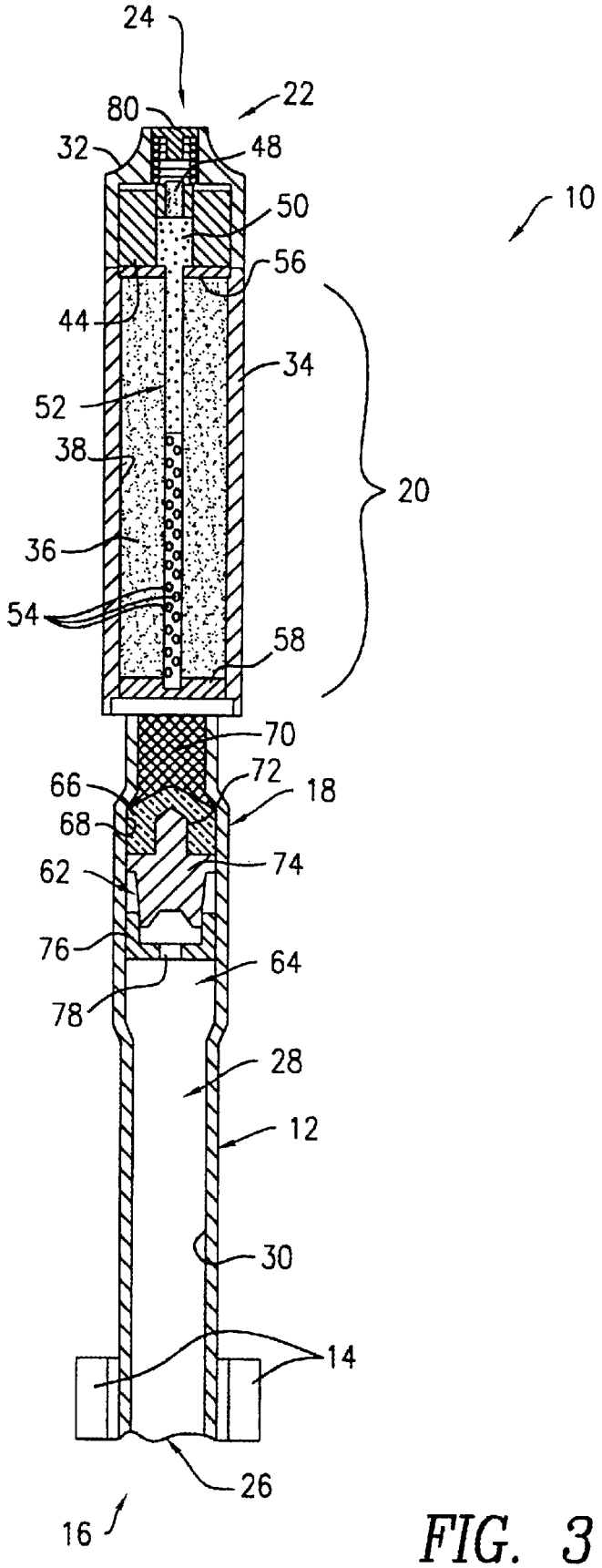
FIG. 3 cross sectional view of the projectile of FIG. 1 illustrating the various components thereof in greater detail.

Referring to FIG. 1, a payload delivering projectile 10 which is adapted to be conveniently launched from the end of a muzzle of a rifle, is shown for one embodiment of the present invention. The projectile 10 generally comprises a tail section 12 with a plurality of radially spaced fins 14 near the bottom end 16 thereof for providing aerodynamic stability, a bullet trap section 18, a payload assembly 20, and a trigger or fuse assembly 22 at the top end 24 thereof. It is noted that the fuse assembly 22 may be adapted to reside in any part of the projectile 10 depending on the payload type and method of dispersal used. The tail section 12 further includes an opening 26 at the bottom end 16 thereof, in communication with a launch tube 28 (as best shown in FIG. 3). The tail section 12 and the launch tube 28 is typically made of a high strength material, such as aluminum alloy, fiber reinforced plastic composite, or steel, depending on the weight and trajectory range requirements of the payload.

The launch tube 28 includes a cylindrical surface 30 (as best shown in FIG. 3) of substantially uniform diameter along its entire cylindrical length. The inner diameter of the launch tube 28 is sized to fit over the muzzle or a fire suppressor component of the rifle muzzle, with a few thousandths of an inch tolerance. The projectile 10 is adapted to be launched from the rifle muzzle end where it proceeds on a trajectory path towards a target area. During the flight or upon reaching the target area, the payload assembly 20 of the projectile 10 is functioned by the trigger or fuse assembly 22 whereupon the corresponding payload is released or discharged therefrom. The payload is discharged in a safe controlled manner for minimizing or preventing injury to persons and damage to property near or at the target area.

More specifically, the present invention utilizes a non-lethal propellant-base payload dissemination mechanism for dispersing an aerosol or non-aerosol material in a safe, efficient and effective manner during combat or non-combat operations. The mechanism is pyrotechnic based which does not depend on explosive means such as high explosives, nor pneumatic means such as "bleed air" for proper functioning. The mechanism generally comprises a frangible casing defining a filler space containing particles of a powder, a liquid or an aerosolizable material, a firing primer in connection with a propellant, and a gas flow regulator providing fluid communication between the propellant and the filler space. When the primer is set off by suitable means, the propellant generates an expanding gas which flows through the regulator into the fill space. As the fill space is pressurized, the contents of the filler space are deagglomerated and fluidized until the frangible casing ruptures and releases the contents in the form of an aerosol cloud. An example of the propellant-based aerosol generating mechanism described above is disclosed and taught in U.S. Pat. No. 6,047,644, the contents of which is incorporated herein by reference in its entirety.

Figure 2:
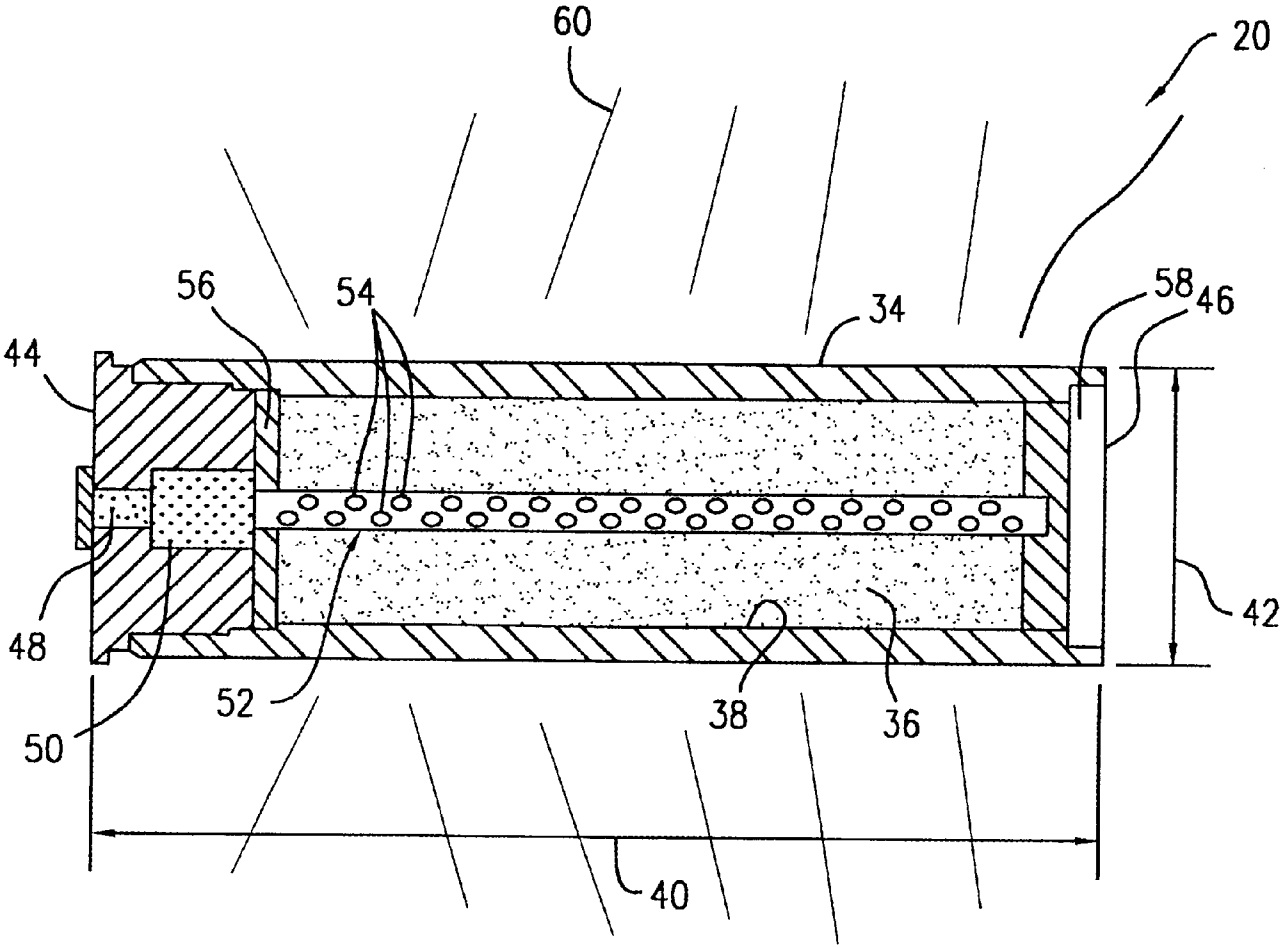
FIG. 2 is a cross sectional view of a payload assembly component from the projectile shown in FIG. 1.

Referring to FIG. 2, the payload assembly 20 of the projectile 10 is shown. The payload assembly 20 includes a frangible casing 34 for holding a payload therein. The frangible casing 34 is composed of any material which permits retention of the powder particles 36 in the payload assembly 20 until a sufficient pressure is attained whereupon discharge occurs while yielding little or no shrapnel or fragments. The frangible casing 34 further defines a filler space 38. Preferably, the frangible casing 34 is composed of a durable, relatively strong material including, but not limited to, plastic, ceramic, cellulose-based material, fibrous material, and the like. In the preferred embodiment, the casing 34 has a cylindrical construction with a length 40 of from about 2 to 6 inches, preferably from about 4 to 5 inches. The diameter or width 42 of the casing is preferably from about 1 to 4 inches, more preferably from about 1 to 3 inches, and most preferably about 1.602 inches. The dimensions of the casing 34 are arranged so that the maximum dispersion of the powder particles 36 within the filler space 38 in the form of an aerosol, can be achieved. It is noted that the width 42, the length 40 and other dimensions of the casing 34 can vary according to factors such as propellant strength, void spacing, payload type and size, dispersal method, and the like.

The payload assembly 20 further includes a base end 44 and a forward end 46. The base end 44 contains a firing primer 48 and a propellant 50 with the firing primer 48 attached to the propellant 50 so that the propellant 50 may be ignited by the primer 48. The firing primer 48 may be any primer type which is capable of initiating burn of the propellant 50, preferably the primer 48 is a percussion primer which is fired by mechanical contact. The filler space 38 is further enclosed by an aft cap 56 and a forward cap 58 for maintaining a tight seal with the frangible casing 34.

The propellant 50 is a non-explosive charge. As compared with high explosives (HE), the propellant 50 used in the present invention is relatively slow burning. The rate of burn of the propellant 50 produces gas generation, creating excessive or large amounts of gas over a short period of time. The payload assembly 20 further includes a diffuser tube 52 extending along a central axis of the assembly 20 from the propellant through the aft cap 56 into the filler space 38. The diffuser tube 52 further includes a plurality of radially directed holes 54 extending through the surface portion thereof. The holes may include any number or size, which is varied dependent on the size of the payload assembly 20 and the amount of the propellant 50 and the powder particles 36 used. The variations of the number and size of the holes may be readily determined by those skilled in the art. The holes 54 are preferably covered by a thin film or paper thin sheet of a perforatable material to retain the powder particles 36 and the propellant 50 in their respective areas. The film may be composed of any material which facilitates this separation. The sheet may be paper, metal such as aluminum foil, fabrics, and the like. Preferably, the holes are covered by adhesive backed paper. The diffuser tube 52 may be composed of a hard, durable material such as plastic ceramic or metal. Preferably, the diffuser tube 52 is metal.

The diffuser tube 52 is adapted to convey the gas generated by the propellant 50 into the filler space 38 via the holes 54. Excessive or large amounts of gas are those amounts which are capable of effectively fluidizing the powder particles 36 as the gases from the propellant 50 travel into the filler space 38. Unlike a high yield explosive reaction, i.e. detonation, which consists of shock wave that travels through the surrounding material, an ignited propellant reaction is a combustion reaction or deflagration that acts as a gas generator system to release kinetic energy in a controlled manner.

The propellants 50 used in the present invention include propellants such as single-base, double-base, triple-base, composite propellant, ball propellant, and similar compounds. Most preferably, the propellant 50 is double-base. Single-base propellants are low cost propellants that have a low flame temperature and low energy content, and contain such compositions as nitrocellulose. Double-base propellants are more energetic than single-base propellants, and may contain such compositions as nitrocellulose gelantinized by nitroglycerin. Triple-base propellants generally contain nitroguanidine as an additional energizer which increase the energy content for the composition without raising the flame temperature. Composite propellants contain a polymer binder, a fuel, and an oxidizer. Ball propellant contains nitrocellulose extracted from waste single-base propellant. Additional types of propellant 50 which function to fluidize the powder particles 36 for the present invention are known to those skilled in the art.

The powder particles 36 may include military payloads of screening obscurant, such as titanium oxide, brass flakes, carbon flakes and fibers, graphite flakes, smoke chaff, and the like. Additionally, civilian payloads of crowd control agents, such as ortho-chlorobenzalmalononitrile (CS) and oleoresin capsicum (OC), smoke, dye indicators, sticky foams, fire retardants, and the like, may be used as powder particles 36 for law enforcement and firefighting uses. When the payload assembly 20 is modified to create an infrared screen, preferably the particles 36 comprise brass flakes. When obscurant are used, those powder particles 36 which are granules preferably have diameters ranging from about 0.5 $\mu$m to 2.0 $\mu$m. When the particles 36 are flakes comprising irregular plate-shaped particles, preferably they have diameters ranging from about 1.0 $\mu$m to 100 $\mu$m. When fibrous materials are used, such as carbon fibers, which are electrically conductive cylinder dipoles, the diameters of the fibers preferably range from about 3.5 $\mu$m to 20 $\mu$m.

The base end 44 and the forward end 46 retains the frangible casing 34 and the forward and aft caps 58 and 56 in place adjacent to the filler space 38. The frangible casing 34 retains the powder particles 36 in the filler space 38 until sufficient pressure is established by the expanding gases of the propellant 50 thereby causing the frangible casing 34 to rupture radially outward and expel the particulate powder 36 therethrough in the form of an aerosol. Preferably the frangible casing 34 withstands pressures of from about 100 psi to 1500 psi prior to rupture, more preferably from about 1200 psi to 1400 psi prior to rupture.

The payload assembly 20 provides for aerosol formation without the use of high explosives and/or use of ordinance-type grenades. It provides instant dissemination of an aerosol in a localized area without fragmentation or shock wave hazards. It further permits dispersion of several types of aerosols. Instead of aerosol payloads, discrete articles of larger size may also be delivered in the manner described above.

FIG. 3 shows a cross sectional view of the projectile 10 illustrating the arrangement of the internal components. The payload assembly 20 described above is securely attached to the tail and the bullet trap sections 12 and 18. For certain applications, the attachment may be modified to permit the payload assembly 20 to disengage from the tail section 12 during delivery of the payload. The bullet trap section 18 defines a substantially cylindrical bore 64 in communication with the launch tube 28. A bullet trap 62 is located and securely retained within the bore 64 of the bullet trap section 18. The bullet trap 62 is used to safely capture and retain the bullet fired from the rifle used to launch the projectile 10. The bullet trap 62 also prevents any damage to the structure of the projectile 10 often associated with loading under high bullet impact acceleration. The bullet trap mechanism which is shown and described in the present invention, is disclosed and taught in U.S. Pat. No. 5,574,245 the content of which is incorporated herein by reference in its entirety.

The bullet trap 62 is comprised of an anvil 66, made of high strength steel alloy. The anvil 66 has a cylindrical exterior surface 68 of a diameter slightly smaller that the diameter of the bore 64. The top external surface of the anvil 66 is tapered to match and abut against a tapered internal surface of an internal bulkhead 70. Forward of the bulkhead 70 is affixed the payload assembly 20. Opening toward the rear of the anvil 66 is an interior surface 72. The interior surface 72 of the anvil 66 has a uniform cylindrical surface portion, followed by a tapered surface portion. This tapered surface defines an internal bulkhead within the anvil 66.

The bullet trap 62 further includes a plug 74 made of aluminum which is adapted to fit into the anvil 66, and an end cap 76 for retaining all the parts of the bullet trap 62 in the bore 64. The plug 74 serves to absorb most of the bullet impact energy and mitigate the shock accelerations before the bullet is finally captured by the anvil 66. The end cap 76 includes a through hole 78 having a diameter slightly larger than the diameter of the bullet, for allowing the fired bullet to enter the bullet trap 62 and be safely captured therein.

It is noted that the bullet trap is not limited to the configuration shown and described herein and may include any conventional bullet trap mechanism that is employed in a rifle muzzle launched projectile for safely capturing and retaining a bullet fired from a rifle.

When the bullet is fired into the launch tube 28, the tube 28 pressurizes with the cartridge gases from the rifle. The explosive gases then begin to propel the projectile 10 away from the rifle muzzle. This entrapped gas pressure is the primary means of propulsion. It has been observed that the momentum of the bullet adds less than 12% to the launch velocity of the projectile 10. The remaining launch velocity is contributed by the cartridge gases. The fired bullet is captured and safely retained by a bullet trap located at the end of the launch tube 28 within the bullet trap section 18. The launched projectile 10 proceeds along a trajectory path to a target area where it may be triggered or initiated at any point along the path using suitable means including, but not limited to, a time-delay fuse or a point-impact fuse. Upon such triggering, the payload assembly 20 operates to release the payload contained in the frangible casing 34. It is noted that the projectile 10 and the payload assembly 20 may each be modified depending on the type of triggering device is to be used and the manner in which the payload is to be released.

With reference to FIGS. 1 and 3, the projectile 10 is shown equipped with a point-impact fuse assembly 32 which upon impact with a hard surface, triggers the discharge of the payload. The point-impact fuse assembly 32 is operatively associated with the payload assembly 20 at the base end 44. With specific reference to FIG. 3, the fuse assembly 32 includes a striker 80 at the nose end of the fuse assembly 32. Upon impact with a target, the striker 80 mechanically contacts the firing primer 48 for effective ignition. The burning primer 48 ignites the propellant 50 initiating the payload dispersal process as described above.

Figure 4:
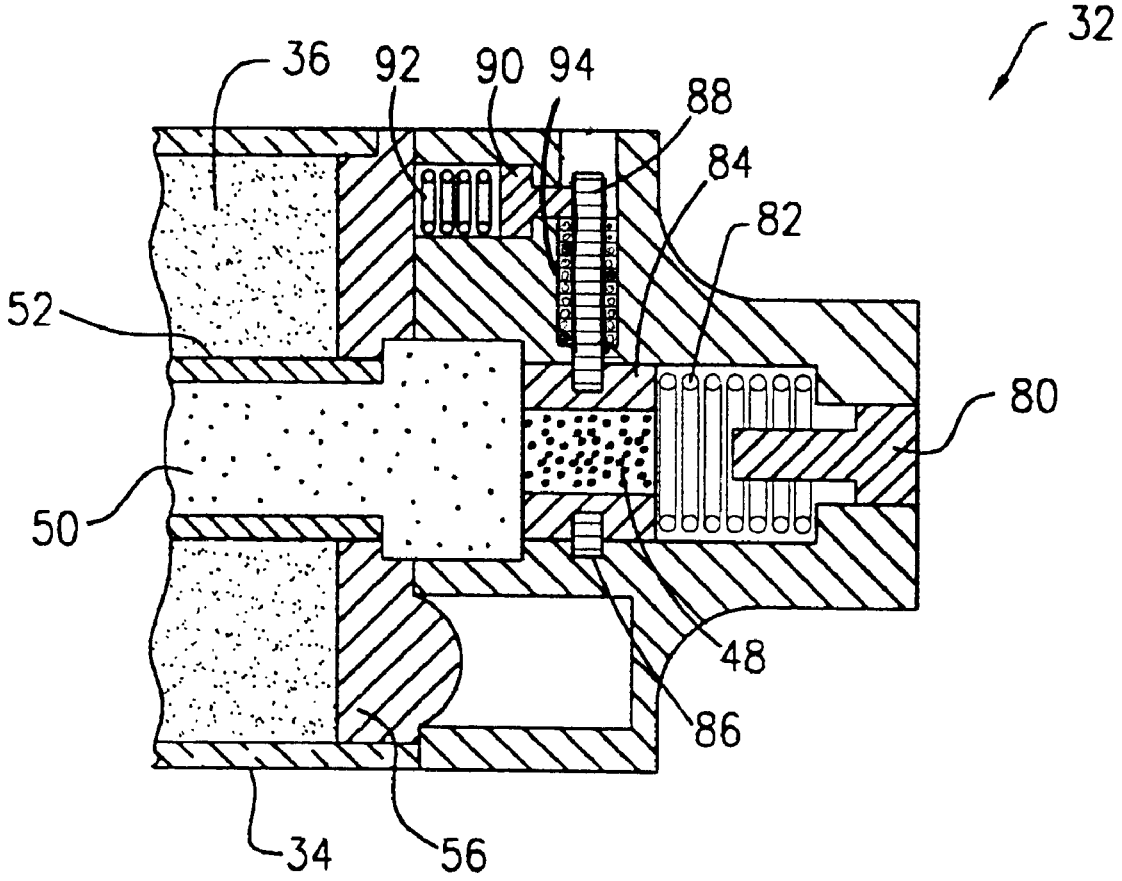
FIG. 4 is an exploded detailed cross sectional view of a point-impact fuse assembly component of the projectile shown in FIG. 1.

Referring to FIG. 4, an exploded detailed view of the point-impact fuse assembly 32 is shown. The point-impact fuse assembly 32 comprises the striker 80, a slider mechanism 84 containing the firing primer 48, a spring 82 for biasing the slider mechanism 84 away from the striker 80, a safing pin 86, a slider pin 88, an arming interlock setback pin 90, a setback spring 92, and a slider pin spring 94. The striker 80 is securely fixed and immovable in the nose end of the assembly 32. The slider mechanism 84 holds a quantity of firing primer 48. The slider mechanism 84 is adapted for longitudinal sliding movement. The spring 82 biases the slider mechanism 84 away from the striker 80. Upon impact with a target, the inertial force of the slider mechanism 84 sufficiently overcomes the spring bias force and contacts the striker 80 for ignition. Once ignited, the slider mechanism 84 returns to its initial position biased by the spring 82. The ignited firing primer 48 comes into contact with and ignites the propellant 50, thus initiating the payload discharge process described above. The point-impact fuse assembly includes safety features for preventing premature discharge of the payload. The safing pin 86 immobilizes the slider mechanism 84 to prevent unintentional contact between the primer 48 and the striker 80 during storage, handling and transportation. The safing pin 86 must be removed by the user prior to launching.

An additional safety mechanism is provided to prevent final arming of the fuse assembly 32 until a launch setback is sensed as the projectile 10 leaves the rifle muzzle. The arming interlock setback pin 90 is biased against the slider pin 88 by the setback spring 92. The slider pin 88 biased radially outward by the slider pin spring 94, is immovably fixed by the biased setback pin 88. The slider pin 88 is adapted to securely engage with the slider mechanism 84 to prevent any longitudinal sliding movement. During launch, the sudden acceleration of the projectile 10, causes the arming interlock setback pin 90 to retract from the slider pin 88. The released slider pin 88 is biased radially away from the slider mechanism 84 by the slider spring 94, thus permanently disengaging from the slider mechanism 84 for final arming of the fuse assembly 32.

With reference to FIGS. 1 to 4, the overall operation of the projectile 10 will be described. The end of the rifle muzzle is first inserted and mounted into the launch tube 28 of the projectile 10 in preparation for launching. The user removes the safing pin 86 and aims the projectile 10. The operator fires a bullet chambered in the rifle to launch the projectile 10. As the bullet travels the length of the rifle muzzle and the launch tube 28, it enters the through hole 78 of the end cap 76, and begins to penetrate the rear surface of the aluminum plug 74. The strength of the bullet is insufficient to resist the strength and density of the aluminum plug 74. As a result, the bullet components begin to expand and decelerate within the central mass of the aluminum plug 74. Eventually, the bullet is captured by the steel anvil 66. The projectile 10 begins to be propelled by the generated cartridge gases, and the setback pin 90 is retracted by setback forces associated with acceleration of the projectile 10 for final arming of the fuse assembly 32. The projectile 10 becomes airborne and follows a trajectory path towards the target.

When the top end 24 of the projectile 10 strikes the target in the course of its trajectory path, the striker 80 contacts and ignites the firing primer 48 which in turn initiates the burning of the propellant 50. As the propellant 50 burns, pressurized gases are generated and flows through the diffuser tube 52. These gases quickly blow through the thin film on the diffuser tube 52 and are released through the diffuser tube 52 in a controlled manner into the filler space 38. The gases flow between the powder particles 36 within the filler space 38 which causes the powder particles 36 to fluidize. As the pressure increases, the frangible casing 34 breaks radially outward, allowing the powder particles 36 to be released in the form of an aerosol 60 into the atmosphere (as shown in FIG. 2).

Figure 5:
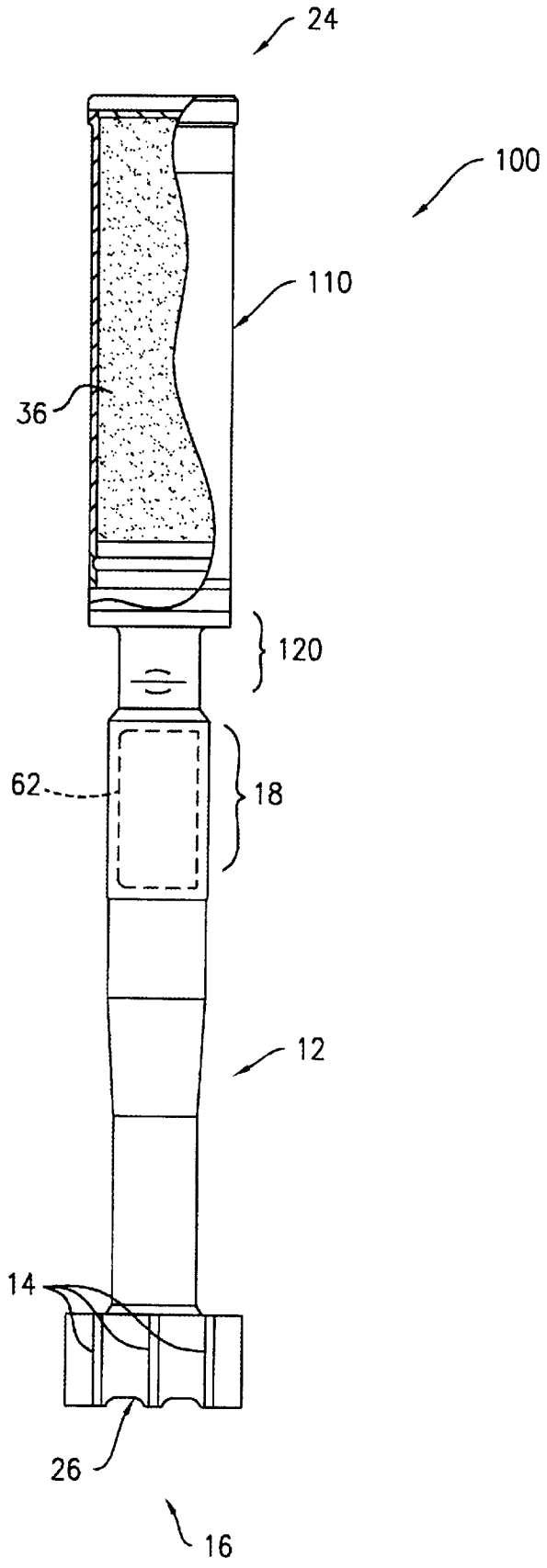
FIG. 5 is a partial cross sectional view of the rifle muzzle-launched projectile for a second embodiment of the present invention.

Referring to FIG. 5, a payload delivering projectile 100 is shown for a second embodiment of the present invention. The projectile 100 is substantially similar to the projectile 10 described above. However, the components comprising the payload assembly and the fuse assembly is different. The projectile 100 includes a payload assembly 110 and a time-delay fuse assembly 120 located near the bullet trap section 18 thereof. In this embodiment, the payload assembly 110 is adapted to discharge the payload 36 through the top end 24 of the projectile 100 for an air burst type of discharge event.

Figure 6:
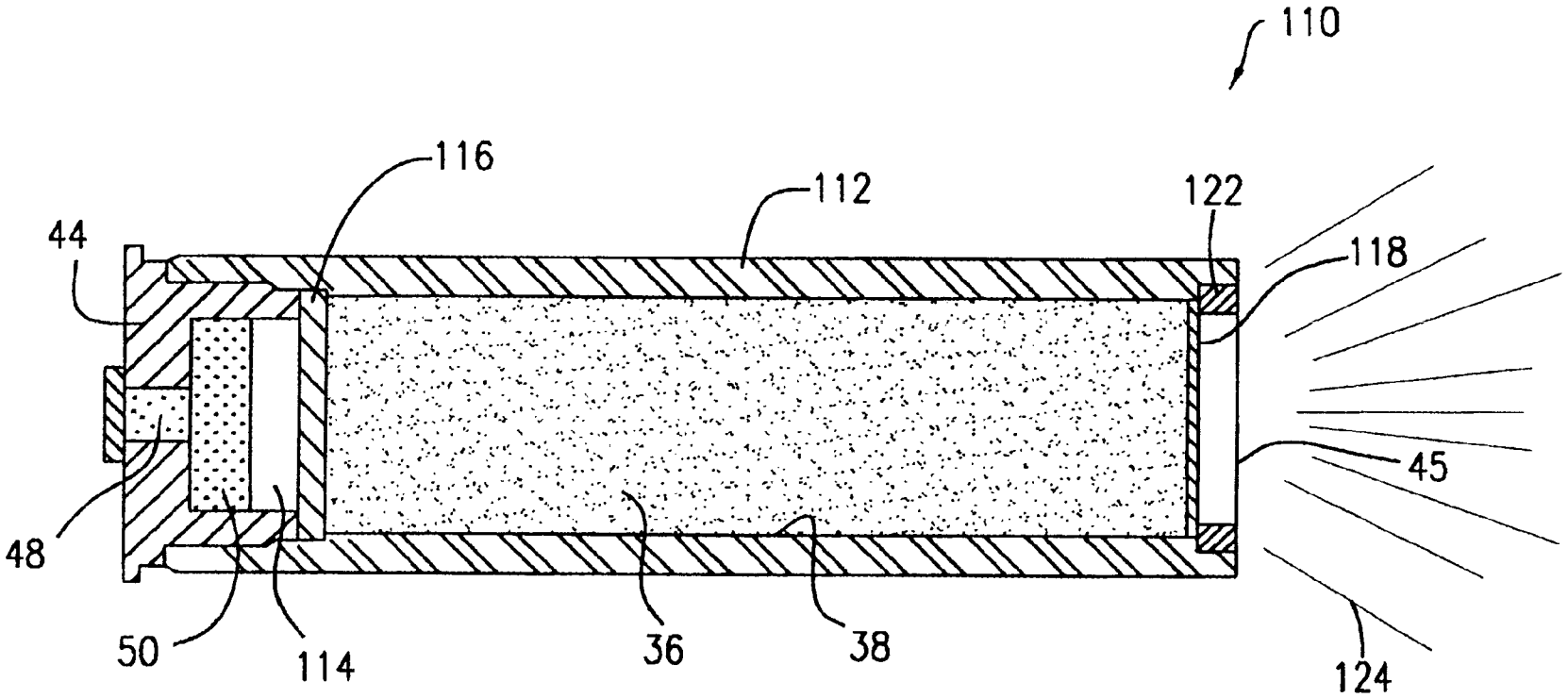
FIG. 6 is a side cross sectional view of a payload assembly component of the projectile shown in FIG. 5.

Referring to FIG. 6, the payload assembly 10 of the projectile 100 is shown. The payload assembly 110 includes a housing 112. The housing 112 can be comprised of any material or construction which permits the containment of the powder particles 36 within a filler space 38. Preferably, the housing 112 is composed of a hard, relatively strong material such as plastic, ceramic, or metal. More preferably, the housing 112 comprises a metal, and most preferably the housing comprises aluminum. In this embodiment, the housing 112 has a cylindrical construction with similar dimensions as the frangible casing 34 of projectile 10.

The housing 112 has a base end 44 and a retainer end 45. The base end 44 contains the firing primer 48 in contact with the propellant 50 so that the propellant 50 may be ignited by the primer 48. The housing 112 may further contain an open area 114 between the propellant 50 and a diffuser plate 116. The open area 114 allows for expansion of the propellant gases from the burning propellant which fluidize powder particles 36 out of the filler space 38 once the propellant 50 has been ignited. Preferably, the open area 114 has a volume ratio to the propellant 50 of 1 to 10, more preferably 1 to 5, even more preferably 1 to 4, and most preferably 1 to 3.

Adjacent to the open area 114 on the opposite side of the propellant 50 is the diffuser plate 116. The diffuser plate 116 partitions the open area 114 and the filler space 38. The diffuser plate 116 is adapted to allow gases generated from the ignited propellant 50 to travel therethrough into the filler space 38. The diffuser plate is unitary in construction and is composed of a solid material for partitioning and separating the propellant 50 from the powder particles 36. The diffuser plate 116 has a thin width of from about 0.0625 inches to 0.25 inches, more preferably from about 0.125 inches thick. Multiple openings or holes are arranged through the face of the diffuser plate 116. The holes may be any number or size, which is varied dependent on the size of the payload assembly 110 and the amount of the propellant 50 and the powder particles 36 used. The diffuser plate 116 preferably has from about 2 to 20 holes, more preferably 4 to 10 holes, and most preferably from 7 to 8 holes. The sizes of the holes is preferably from about 5.0 to 10 mm in diameter, more preferably from about 7.0 to 8.0 mm in diameter. The holes are covered by a paper thin film or sheet to retain powder particles 36 and the propellant 50 in their respective areas as described above. The diffuser plate 116 is composed of a durable, high strength material such as plastic, ceramic, or metal. Preferably, the diffuser plate 116 is metal.

The filler space 38 is located inside the housing 112 adjacent to the diffuser plate 116 at one end, and a frangible end seal or rupture disk located at the retainer end 45 of the housing 112. The filler space 38 is preferably from about 1.0 to 3.0 inches long, more preferably about 2.5 inches long. The volume of the filler area 38 is preferably from about 1.35 to 5.0 cubic inches, most preferably about 3.5 cubic inches. The powder particles 36 are located within the filler space 38.

At the retainer end 45 of the housing 112, a retaining ring 122 holds the frangible end seal (rupture disk) 118 in position adjacent to the filler space 38. The frangible end seal 118 holds the powder particles 36 in the housing 112 until sufficient pressure is generated by expanding gases of the propellant 50 to discharge the particles 36 in the form of an aerosol cloud 124. The end seal 118 is composed of any material which permits retention of the powder particles 36 in the housing 112 until a desired pressure is reached with minimal formation of shrapnel fragments or shock wave. Preferably, the end seal 118 is a frangible material such as cellulose, plastic, fibrous material, elastomer, metal, and the like.

As the propellant 50 burns, gases generated in the open area 114, rapidly blow through the thin sheet of material covering the diffuser plate 116. The gases are released through the diffuser plate 116 in a controlled manner into the filler space 38 where the gases fluidize the powder particles 36 under pressure. The gases flow between the powder particles 36 to fluidize and deagglomerate prior to being expelled through the end seal 118.

The projectile 100 is adapted for discharging its payload for air-burst delivery at any point along its trajectory path. The projectile 100 includes a time-delay fuse assembly 120 located between the payload assembly 110 and the bullet trap assembly 62 as will be described.

Figure 7:
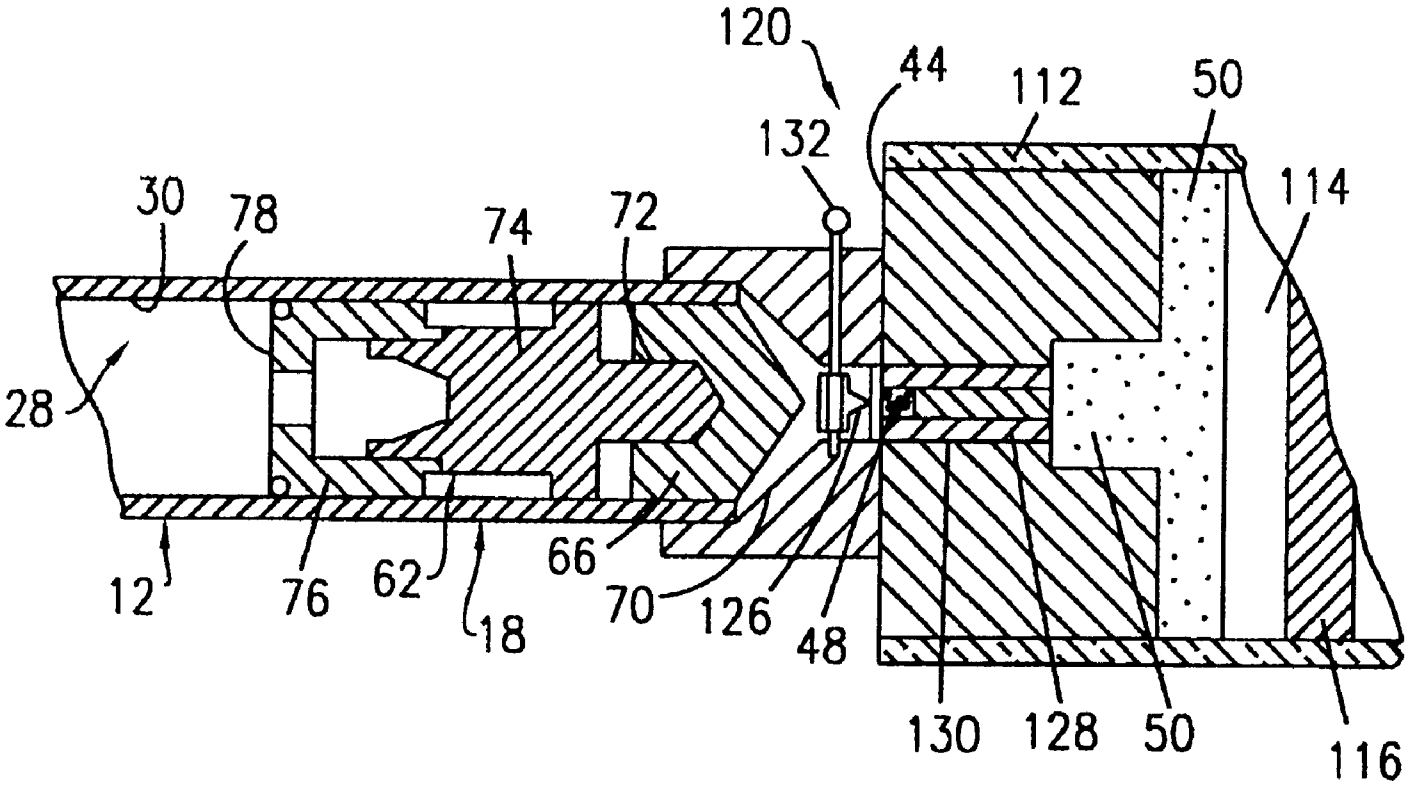
FIG. 7 is an exploded detailed cross sectional view of a time-delay fuse assembly component for activating the projectile of FIG. 5 during delivery.

Referring to FIG. 7, the time-delay fuse assembly 120 is shown for a more detailed view of the components arranged therein. The fuse assembly 120 includes a striker 126 in abutting engagement with the bullet trap assembly 62 specifically with the anvil 66, a tube 130 containing a primer 48 and a pyrotechnic delay column, and a propellant 50. A safing pin 132 is operatively engaged with the striker to prevent premature ignition of the primer 48. Prior to launching the safing pin 132 must be removed for proper operation. When the rifle is fired, the bullet is captured by the bullet trap assembly 62. The momentum of the fired bullet is transferred from the anvil 66 to the striker 126. Upon contact with the anvil 66, the striker 126 is adapted to mechanically strike a percussion primer 48 for ignition of the fuse assembly 120. The percussion primer 48 is in contact with a pyrotechnic delay column 128 in the tube 130. The pyrotechnic delay column 128 is adapted to burn at a slower rate to delay ignition of the propellant 50 locate at the end of the tube 130. After a span of time, the pyrotechnic delay column 128 burns completely through where it ignites the propellant 50 initiating the payload dispersal process as described above.

With some modifications, the point-impact fuse assembly 32 similar to the one shown in FIG. 4, may be incorporated into the projectile 100. The point-impact fuse assembly 32 is mounted at the top end 24 and the discharge end seal 118 is located at the opposite end of the payload assembly 110. During impact the payload assembly 110 is adapted to disengage from the tail section 12 for effecting payload discharge.

Figure 8:
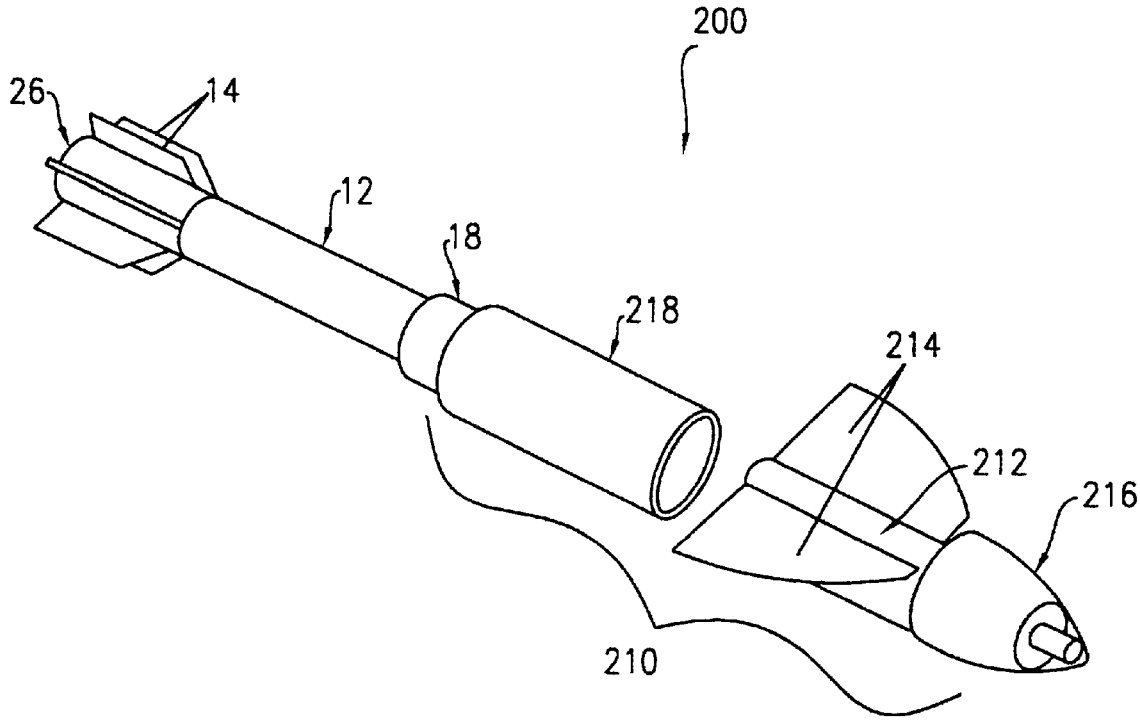
FIG. 8 is a perspective view of a projectile for a third embodiment of the present invention adapted for delivering an unmanned aerial vehicle over or near a target area.

In a third embodiment of the invention, a projectile 200 is shown with a modified pay load assembly 210 in FIG. 8. The projectile 200 is capable of being launched from the end of a rifle muzzle in the same manner described above. The payload assembly 210 is adapted to transport a relatively lightweight detachable device at the nose portion of the projectile 200. It is noted that the relatively lightweight detachable device may include a multitude of devices which may be delivered from the end of a rifle muzzle. The payload assembly 210 includes an unmanned aerial vehicle (UAV) 212 which is adapted to detach from the payload assembly 210 at a set time or position after launching. The payload assembly 210 basically comprises a cylindrical body 218 attached to the rear portion of the UAV 212 by one or more detachable fasteners (not shown). The detachable fasteners may include any fasteners which can cause detachment of the fastened parts at a select time or place during delivery flight. The UAV 212 includes a pair of wing structures 214 adapted for keeping the UAV 212 airborne, and an apparatus 216 in the nose portion thereof. The apparatus 216 may include surveillance equipment, electronic jamming device, a camera, and the like which may facilitatively be carried by the UAV 212 over a length of distance. Once the UAV 212 is released or jettisoned from the projectile 200, the UAV 212 can remain in an airborne flight path for a period of time. In this manner, the projectile 200 enables military personnel to deliver a camera or a listening device over an enemy territory for surveillance purposes over a significant amount of distance with minimal risk to the military personnel.

Although various embodiments of the invention have been shown and described, they are not meant to be limiting. Those of skill in the art may recognize various modifications to these embodiments, which modifications are meant to be covered by the spirit and scope of the appended claims.

What is claimed is:

1. A rifle-muzzle launched payload delivering projectile, comprising:

(a) a launch tube defining an interior cavity, and having an opening at one end with an inner diameter sized to fit over the end of a muzzle of a rifle;

(b) a bullet trap fixedly located in said launch tube cavity opposite from the launch tube opening, said bullet trap adapted for safely capturing a bullet fired from said muzzle; and (c) a payload assembly mounted on said launch tube opposite from said opening end, said payload assembly further configured for safely releasing a payload associated therewith in a controlled manner during delivery in absence of shrapnel formation or fragmentation, and wherein said payload assembly further comprises:

(i) a casing having a distal end and a proximal end, said casing defining a chamber adapted for retaining an aerosol composition;

(ii) a propellant housed in a reservoir in said casing for generating an expandable gas into said chamber upon ignition thereof;

(iii) a primer for igniting said propellant; and (iv) a frangible portion of said casing in contact with the aerosol composition, said frangible casing portion adapted for safely rupturing in a controlled manner under pressure generated by said propellant after ignition, whereby an aerosol cloud is expelled and released into the atmosphere therefrom.

2. The projectile of claim 1, further comprising:

a gas channeling assembly extending longitudinally within said chamber in communication with said propellant reservoir for regulating the flow of the gas radially outward therealong into said chamber; and said frangible casing portion extending radially around said casing for radial expulsion of said aerosol composition.

3. The projectile of claim 2, wherein the gas channeling assembly further comprises:

a tubular member extending longitudinally from the propellant reservoir into the aerosol composition chamber, said tubular member adapted for providing fluid communication between the propellant reservoir and the chamber during operating;

a plurality of radially directed pores disposed in surface of said tubular member; and a thin film surrounding and in contact with said tubular member.

4. The projectile of claim 1, wherein the payload is selected from the group consisting of an aerosol composition, electronic devices, unmanned aerial vehicles, flash-bang munitions, sting balls, concussion grenades, and explosive devices.

5. The projectile of claim 4, wherein the aerosol composition is further selected from the group consisting of smoke, crowd control agents, biological agents, chemical agents, obscurants, marking agents, dyes and inks, chaffs and flakes.

6. The projectile of claim 1, wherein the launch tube further comprises a plurality of tail fins extending radially therefrom in a spaced-apart manner proximate to the launch tube opening for providing aerodynamic stability to the projectile.

7. The projectile of claim 1, wherein said payload assembly is further adapted for air-borne flight.

8. The projectile of claim 1, further comprising an impact fuse assembly for activating said primer upon impact of said projectile with a target.

9. The projectile of claim 8, wherein the impact fuse assembly further comprises a safety mechanism to prevent or reduce occurrence of premature activation of said primer during storage, handling and transportation of said projectile.

10. The projectile of claim 1, wherein the frangible portion of said casing is made of a cellulose-based material.

11. The projectile of claim 1, wherein the propellant is selected from the group consisting of single-base propellants, double-base propellants, triple-base propellants, composite propellants, and ball propellants.

12. The projectile of claim 1, wherein the bullet trap further comprises:

a bullet opening in coaxial alignment with the launch tube opening, for permitting the bullet fired from said rifle to pass therethrough;

a plug with an interior cavity opening rearward in communication with the bullet opening, said plug being configured for absorbing the penetrating energy of said bullet to mitigate the peak impact acceleration of said bullet; and an anvil in contact with a forward portion of said plug, said anvil adapted for retaining the hard component of said bullet and prevent further penetration of said bullet.

* * * * *

UNITED STATES PATENT AND TRADEMARK OFFICE

CERTIFICATE OF CORRECTION

PATENT NO. : 6,523,478 B1
DATED : February 25, 2003
INVENTOR(S) : Gonzalez, N. et al.

It is certified that error appears in the above-identified patent and that said Letters Patent is hereby corrected as shown below:

Column 1,
Line 29, delete “chemical/biological agents”.

Column 2,
Line 32, delete “biological/chemical agents”.

Column 3,
Line 61, delete “biological/chemical agents”.

Column 12,
Line 14, delete “biological agents, chemical agents”.

Signed and Sealed this

Seventh Day of February, 2006

JON W. DUDAS
*Director of the United States Patent and Trademark Office*